US005118208A

United States Patent [19]

Kitahara et al.

[11] Patent Number: 5,118,208

[45] Date of Patent: Jun. 2, 1992

[54] PRINTER WITH INTERLOCKED MOVABLE PLATEN AND PRESSER

[75] Inventors: Satoshi Kitahara, Mishima; Osamu Koizumi, Shizuoka, both of Japan

[73] Assignee: Tokyo Electric Co., Ltd., Tokyo, Japan

[21] Appl. No.: 728,239

[22] Filed: Jul. 10, 1991

[30] Foreign Application Priority Data

Jul. 13, 1990 [JP] Japan ..... 2-186885

[51] Int. Cl.[5] ..... B41J 11/20

[52] U.S. Cl. ..... 400/56; 400/120; 400/58; 400/642

[58] Field of Search ..... 400/120, 56, 58, 642, 400/636

[56] References Cited

U.S. PATENT DOCUMENTS 4,575,267 3/1986 Brull ..... 400/56
4,886,384 7/1989 Harry ..... 400/223
5,000,591 3/1991 Burgess ..... 400/56
5,061,095 10/1991 Asai et al. ..... 400/636
5,062,722 11/1991 Shiozaki ..... 400/120
5,064,300 11/1991 Kashiwabe ..... 400/56

*Primary Examiner*—Eugene H. Eickholt
*Attorney, Agent, or Firm*—Frishauf, Holtz, Goodman & Woodward

[57] ABSTRACT

A printer includes a print head and a platen roller facing the head. The platen roller is supported by supporting frames. The frames are rotatably supported by a stationary shaft. A second set lever is mounted on the supporting frame to be movable integrally with the frames, and includes a pressing portion facing a paper guide. The paper guide is pressed against a feed roller for feeding a paper sheet passing between the head and the platen roller. When the supporting frames are rotated in a direction to leave the platen roller from the head by a first set lever, the pressing portion pushes the paper guide so as to leave it from the feed roller.

11 Claims, 5 Drawing Sheets

PRINTER WITH INTERLOCKED MOVABLE PLATEN AND PRESSER

BACKGROUND OF THE INVENTION

1. Field of the Invention

The present invention relates to a printer for printing information on a paper sheet passing between a stationary print head and a platen, by means of the print head.

2. Description of the Related Art

Recently, there have been developed a printer such as a label printer, which includes a printing section having a stationary print head and a platen movable in directions to touch and leave the print head and a paper feed mechanism for feeding a paper sheet to the printing section. The platen is pressed against the print head by means of an urging force of a spring. The feed mechanism has a feed roller and a paper holder, e.g. an idler roll, pressed against the feed roller by a spring. The paper holder is arranged for engagement with and disengagement from the feed roller.

The printer is provided with a mechanism for releasing the platen from the print head against the urging force of the spring in order to set a paper sheet on the printer. The printer is further provided with another mechanism for leaving the paper holder from the feed roller. Both mechanisms are separately operated by hand.

Prior to setting a paper sheet, the two mechanisms are independently operated so as to define spaces between the print head and the platen and between the holder and the feed roller, respectively. The paper sheet is then introduced into the space between the holder and the feed roller, and fed into the space between the print head and the platen.

However, in the foregoing arrangement of the printer, the releasing of the platen from the print head and the spacing of the paper holder from the feed roller should be executed independently. Accordingly, the setting of a paper sheet will be troublesome and the mechanical arrangement itself may hardly become simple.

SUMMARY OF THE INVENTION

It is an object of the present invention to provide a printer on which a paper sheet can be set with ease.

For achievement of the above object, a printer according to the present invention comprises: a support base; a print head attached to the support base; a platen unit including a platen arranged opposite to the print head, a stationary shaft attached to the support base, a support member supporting the platen and rotatably mounted on the stationary shaft so that the platen is movable in directions to touch and leave the print head, and means for urging the platen toward the print head; feeding means having a feed roller and a holder pressed against the feed roller, for feeding a recording medium supplied between the feed roller and the holder to a position between the print head and the platen by means of the rotation of the feed roller; interlocking means having a pressing portion provided for engagement with the holder and mounted on the platen unit to be movable integrally with the support member, for separating the holder from the feed roller by the pressing portion when the support member is rotated in the direction to leave the platen from the print head; and operating means for rotating the support member of the platen unit in the direction to leave the platen from the print head.

According to the printer constructed as described above, when the support member of the platen unit is rotated against the urging force of the urging means by the operating means, the platen is spaced from the print head. Also, in interlock with the rotation of the support member, the interlocking means is rotated. Then, the pressing portion of the interlocking means, facing the holder, presses the holder so as to leave it from the feed roller. More specifically, the action of the single operating means triggers releasing of the platen from the print head and also, departing of the holder from the feed roller. Accordingly, the setting of a recording medium on the printer will be executed by a simple procedure.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

FIGS. 1 to 7 illustrate a label printer according to an embodiment of the present invention, in which:

FIG. 1 is a perspective view of an essential part of the label printer with a casing being removed;

FIG. 2 is a cross sectional view of the label printer in normal action;

FIG. 3 is a perspective view of a platen unit;

FIG. 4 is a cross sectional view showing an operating lever mechanism in a normal operation of the label printer;

FIG. 5 is a cross sectional view showing the operating lever mechanism in the setting of a paper sheet on the label printer;

FIG. 6 is a cross sectional view showing the action of a power releasing mechanism in a backward feeding of the paper sheet; and FIG. 7 is a cross sectional view showing the positional relationship between first and second set levers.

DETAILED DESCRIPTION OF THE PREFERRED EMBODIMENT

An embodiment of the present invention will be described in the form of a label printer referring to the accompanying drawings.

Figure 1:
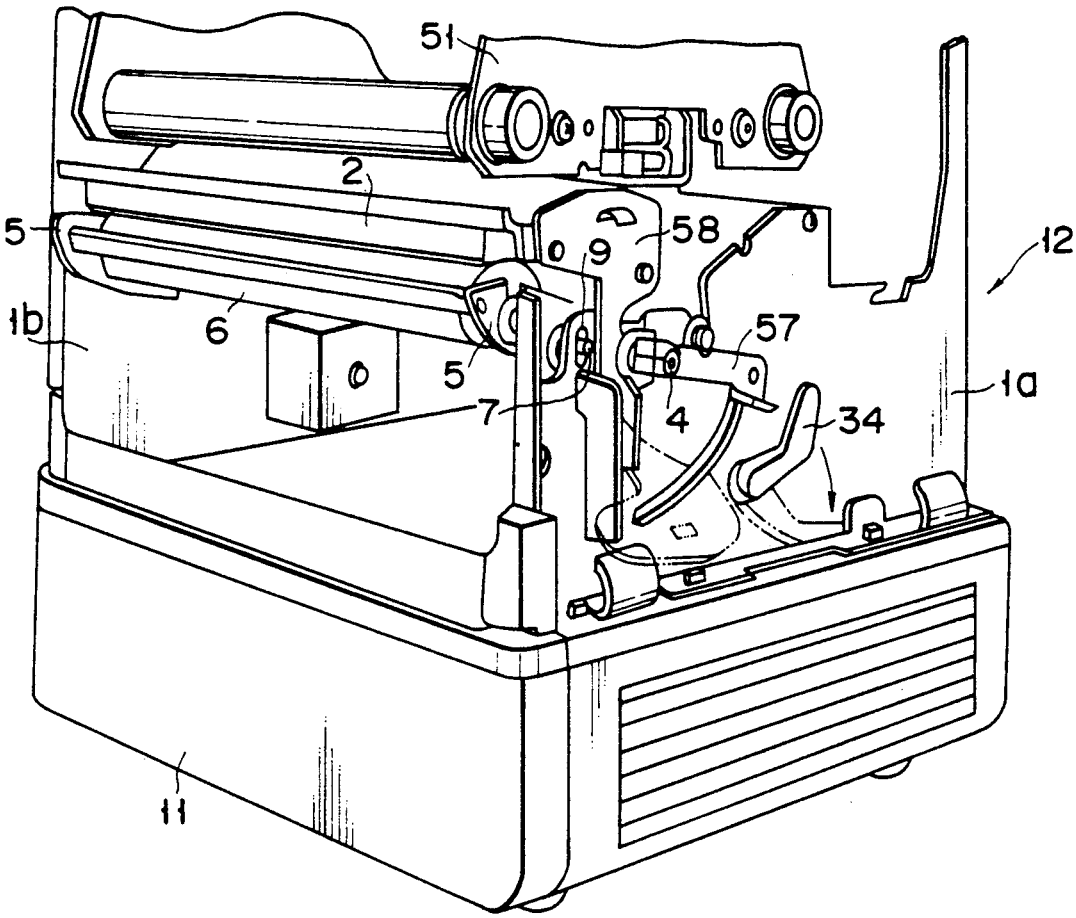
Figure 2:
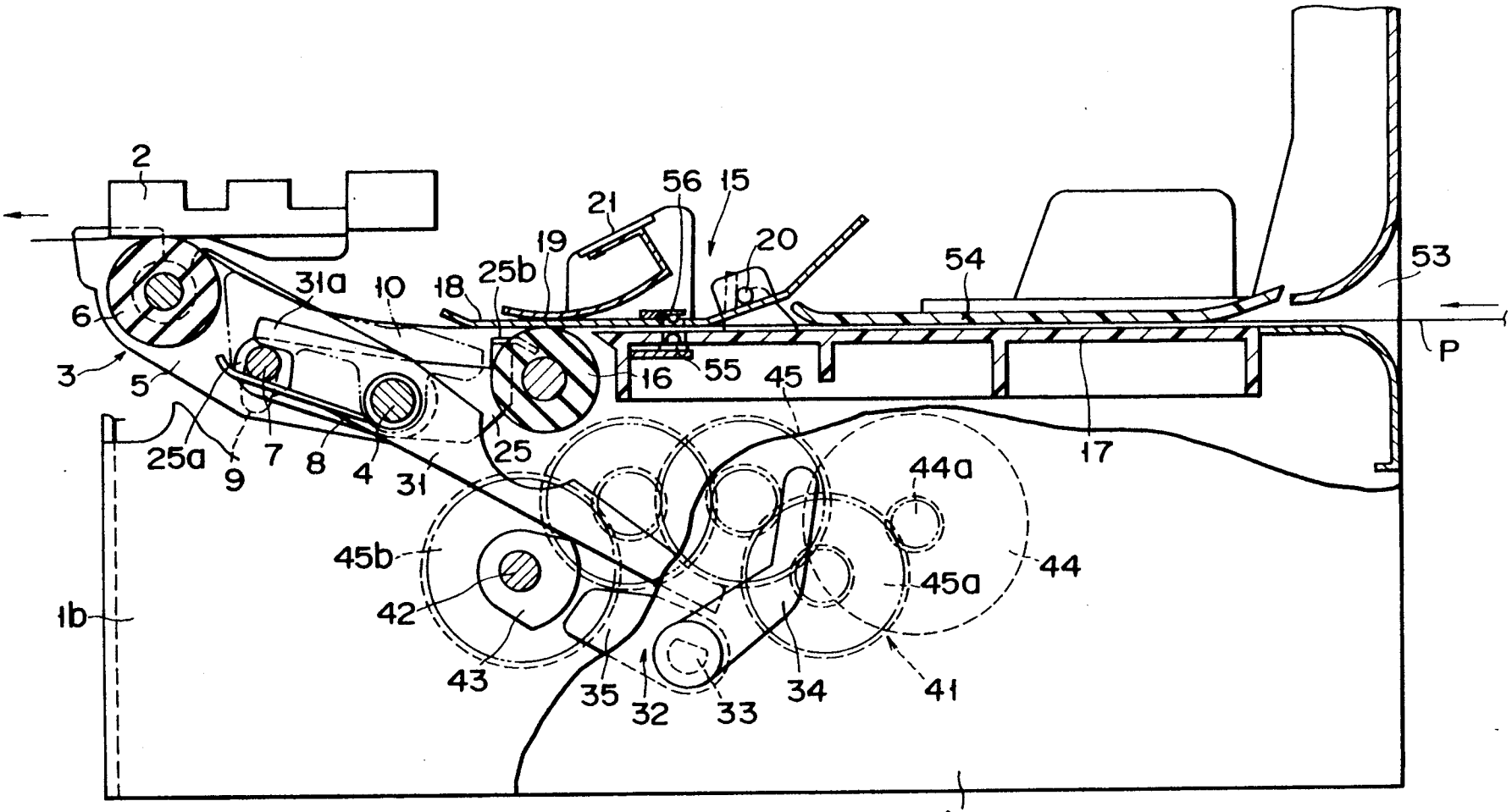

As shown in FIGS. 1 and 2, the label printer includes a base 11 and a body frame 12 mounted on the base 11 for serving as a supporting body. The body frame 12 has a pair of left and right frame side plates 1*a* and 1*b* arranged upright on the base 11 and facing to each other. The frame 12 is covered with a casing, not shown, which is detachably attached to the base 11.

A print head 2 and a platen unit 3 are arranged between the side plates 1*a* and 1*b*, the former overlying the latter. The print head 2 is a line thermal head having a length substantially equal to the axial length of a platen roller described later, and fixedly stretched between the two side plates 1*a* and 1*b* for no movement.

Figure 3:
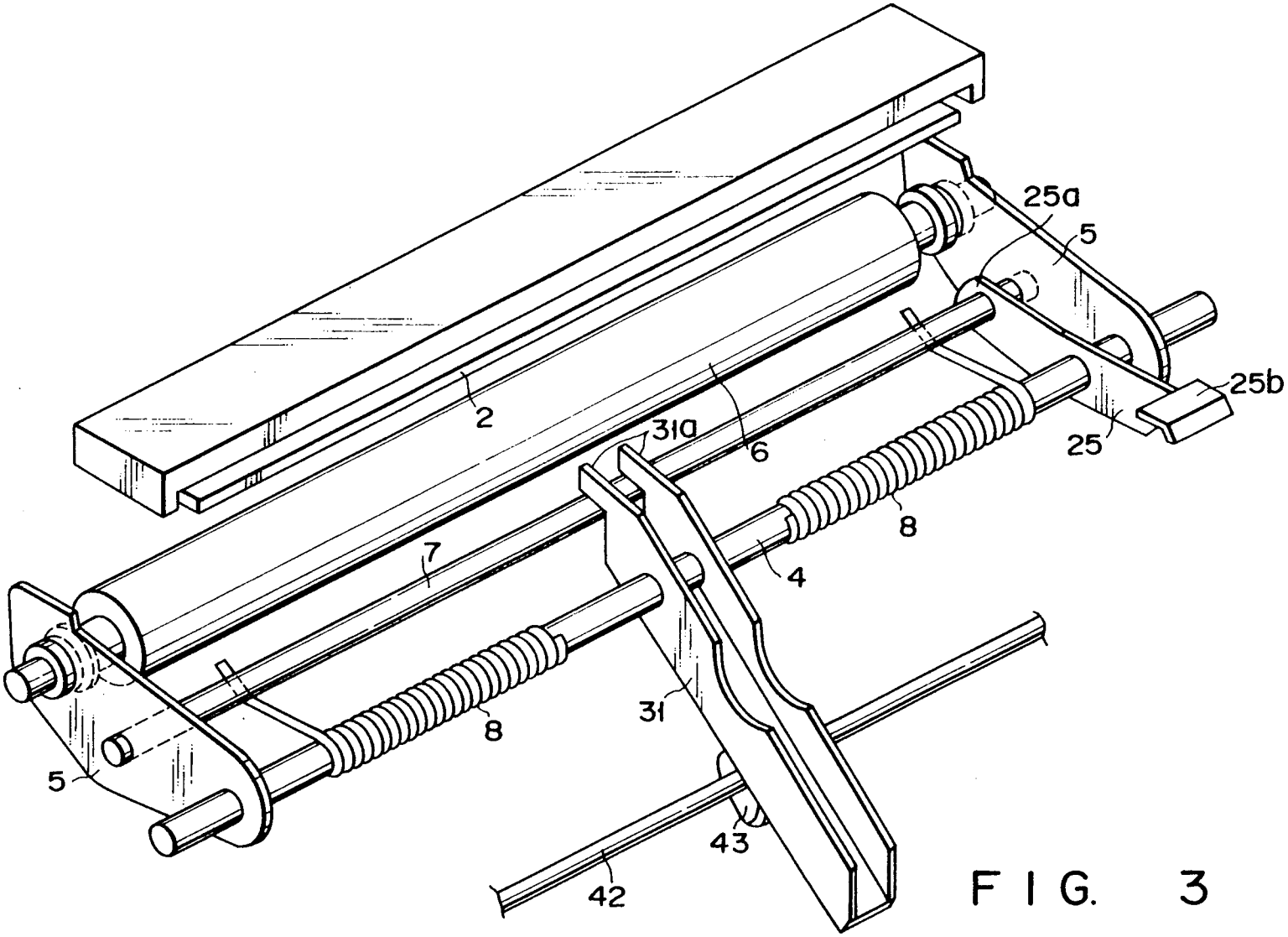

The platen unit 3 best shown in FIGS. 2 and 3 comprises a stationary shaft 4, a pair of left and right platen frames 5 of plate shape, a platen roller 6, a pressure shaft 7, and a pair of torsion coil springs 8 for acting as urging means.

More specifically, the stationary shaft 4 is transversely arranged between the side plates 1*a* and 1*b*, and the platen frames 5 are mounted on both end portions of the shaft 4 to be rotatable about the axis of the shaft 4. The platen roller 6 is rotatably stretched between the respective front end portions of the platen frames 5 and extends in parallel to the print head 2. The pressure shaft 7 is stretched between the platen frames 5 and arranged in parallel to and between the stationary shaft 4 and the platen roller 6. Each end of the pressure shaft 7 penetrates its corresponding platen frame 5 and is inserted in an arcuate guide slot 9 which is bored through its corresponding side plate. The torsion coil springs 8 are wound on the stationary shaft 4. One end of each spring 8 is fixed to the shaft 4, while the other end is pressed against the pressure shaft 7 under the same. In FIG. 2, reference numeral 10 denotes a paper guide mounted on the platen unit 3, for guiding a paper sheet as a recording medium between the print head 2 and the platen roller 3. The paper P used is an elongated continuous base paper on which labels are pasted at regular intervals.

The platen unit 3 is urged by the spring force of the torsion coil springs 8 in the clockwise direction about the stationary shaft 4 as illustrated in FIG. 2. Hence, the platen roller 6 is pressed against the lower surface of the printing head 2. The platen unit 3 can be rotated in the counter-clockwise direction about the shaft 4 by means of a first set shaft 31 described latter. Also, the platen roller 6 is adapted to be rotated by a platen drive mechanism which is provided with a pulse motor as a power source but not shown herein.

A paper feed mechanism 15 is provided in the rear of the platen unit 3 and between the two frame side plates 1*a* and 1*b*. The mechanism 15 comprises a feed roller 16, a lower paper guide 17, a paper holder 18, and a backup leaf spring 19, as shown in FIGS. 1 to 5.

The feed roller 16 is located in the rear of the paper guide 10 and transversely arranged between the side plates 1*a* and 1*b* for rotating motion. The feed roller 16 is rotated in synchronism with the platen drive mechanism. The lower paper guide 17 is transversely arranged between the side plates 1*a* and 1*b*, thus extending from the feed roller 16 to a inlet aperture 53 formed in the rear portion of the body frame 12. The paper holder 18 which acts as a paper guide is formed of planar shape extending from the feed roller 16 to the lower paper guide 17. The front end portion of the holder 18 is located above the rear end of the paper guide 10. The holder 18 is supported by the body frame 12 for pivotal movement about a pivot 20 and urged downward to be pressed against the feeding roller 16 by the leaf spring 19. The leaf spring 19 is fixedly coupled to a traverse plate 21 stretched between the frame side plates 1*a* and 1*b*. An upper paper guide 54 is arranged above the lower paper guide 17, extending from the rear of the holder 18 to the inlet aperture 53.

In operation, the paper sheet P is passed through the aperture 53, as indicated by arrow in FIG. 2, to be introduced into the portion between the upper and lower paper guides 54 and 17, and is further advanced to be clamped between the feed roller 16 and the paper holder 18. In this state, as the feed roller 16 of the feed mechanism 15 is actuated for rotation, the paper sheet P is fed between the print head 2 and the platen roller 6. The paper holder 18 is detachably attached to the frame side plates 1*a* and 1*b*, and when the paper sheet P gets stuck up in a transfer path, will be detached for removal of the jammed sheet.

A light emitting element 55 formed of a light emitting diode is mounted on the lower paper guide 17 and adjacent to the feed roller 16. Also, a light receiver 56 is mounted on the holder 18 so as to face the emitting element 55. Hence, the light emitted from the light emitting element 55 towards the light receiver 56 passes the paper sheet P running between the lower paper guide 17 and the paper holder 18 prior to entering the light receiver 56. The intensity of the incoming light onto the light receiver 56 is varied depend on the thickness of the paper paper P which is different between a label carrying region and a no-label region. Accordingly, the light receiver 56 delivers an output signal corresponding to the intensity of the received light. More specifically, the presence of each label on the paper sheet P is detected by a label sensor 58 having the light emitting element 55 and the light receiver 56. Then, the operation of the paper feed mechanism 15 is controlled by a controller, not shown, according to the output signal from the light receiver 56. As the result, the paper sheet P can be fed to a desired length.

A pair of second set levers 25 (one is shown) which act as interlocking means are provided at the left and right end portions of the platen unit 3 or outside the paper path defined by the maximum width of the paper sheet P to be used. As shown in FIG. 2 and 3, each set lever 25 is arranged adjacent to its corresponding platen frame 5 and fitted at its middle portion onto the stationary shaft 4 for pivotal motion. The front end 25*a* of the second set lever 2 is rotatably fitted onto the pressure shaft 7. The rear end of the lever 25 extends upward and incorporates a flat pressing portion 25*b* arranged in bent form. The pressing portion 25*b* is arranged to face the front bottom of the paper holder 18 and commonly, spaced from the same.

Figure 4:
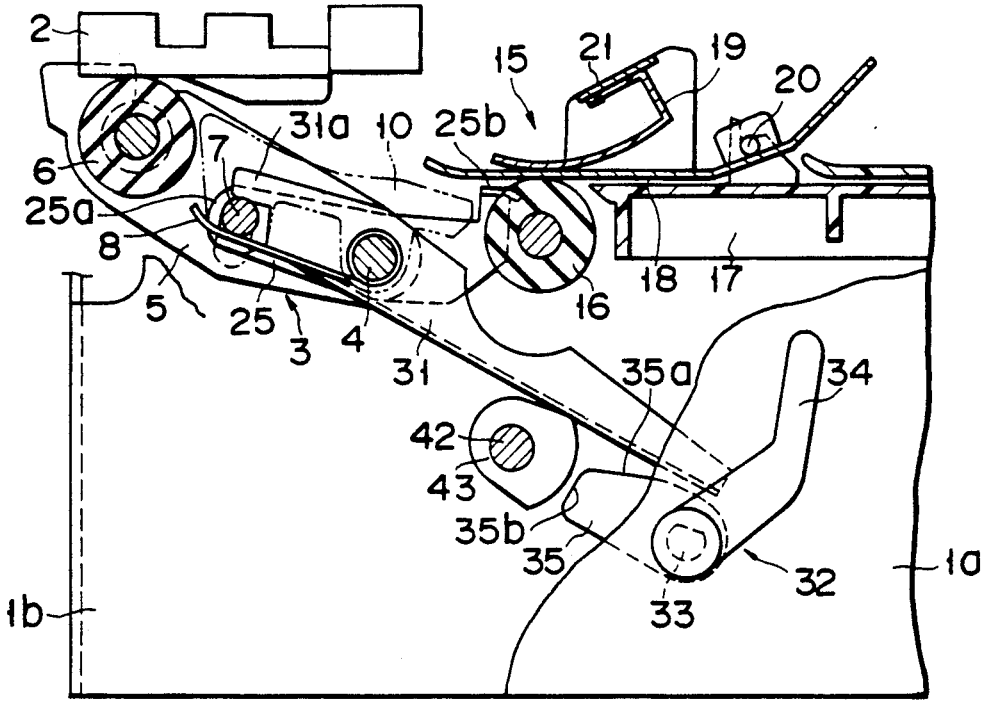

As shown in FIGS. 2 to 4, the first set lever 31 is rotatably fitted at its middle portion on the stationary shaft 4 and situated between the two torsion coil springs 8. The front end 31*a* of the first set lever 31 sits directly on the upper side of the pressure shaft 7, that is, the side opposite to the side on which the springs 8 engage. An operation mechanism 32 for manually rotating the first set lever 31 comprises a first rotating shaft 33, an operating lever 34, and a first cam 35.

The first rotating shaft 33 is transversely stretched between the frame side plates 1*a* and 1*b* for rotation and extends parallel to the stationary shaft 4. One end of the shaft 33 penetrates through the side plate 1*a* and is fixedly coupled to the operating lever 34. The first cam 35 is fixedly mounted on the first rotating shaft 33 for direct engagement with the rear bottom of the first set lever 31. The first cam 35 has an arcuate cam surface 35*a* and a planar stopper surface 35*b* continuous with the surface 35*a*.

Figure 5:
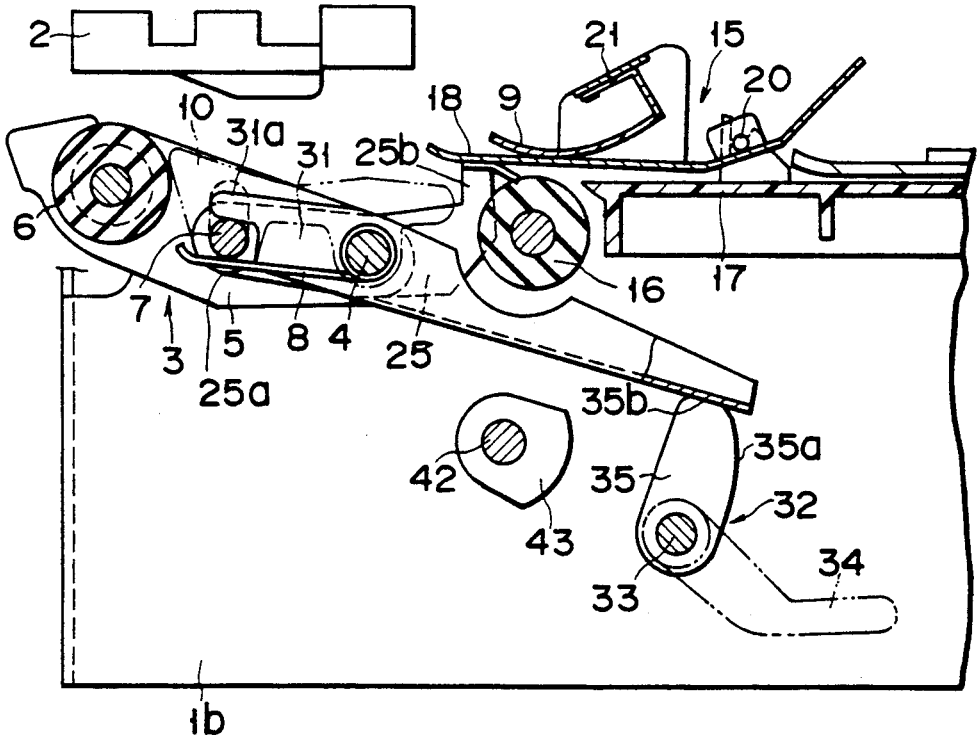

In action, the clockwise movement, in FIG. 4, of the operating lever 34 of the operation mechanism 32 causes the cam surface 35*a* to come into contact with the bottom of the first set lever 31, thereby lifting up the lever. Thus, the first set lever 31 is rotated about the stationary shaft 4 in the counter-clockwise direction, and its front end 31*a* presses down the pressure shaft 7 against the urging force of the coil springs 8. Accordingly, the platen frames 5 coupled to the pressure shaft 7 are lowered, and the platen roller 6 moves downward and becomes widely spaced from the print head 2, as illustrated in FIG. 5.

In interlock with the downward movement of the pressure shaft 7, the front ends 25*a* of the second set levers 25 are moved downward, so that the levers 25 are rotated in the counter-clockwise direction about the stationary shaft 4. Hence, the pressing portions 25*b* of the second set levers 25 move upward and raise the front end of the paper holder 18 as shown in FIG. 5. As the result, the holder 18 rotates about the pivot 20 thus departing from the feed roller 16.

After the lifting of the first set lever 31 by the planar stopper surface 35*b* of the same comes at a proper pressure into contact with the bottom of the first set lever 31 and thus, the first cam 35 is positioned perpendicular to the bottom of the first set lever 31. During the engagement, the first set lever 31 urged by the torsion coil springs 8 remains sustained across the first cam 35 by the first rotating shaft 33. Accordingly, when the operating lever 34 is released, each component of the printer can be maintained in its position as shown in FIG. 5. As understood, by rotating the operating lever 34 upward from the position shown in FIG. 5, each component is returned to its original position shown in FIG. 2 or 4 by the urging force of the coil springs 8.

As shown in FIG. 2, the printer also has an automatic separating mechanism 41 for use in backward feeding of the paper sheet P. The mechanism 41 comprises a second rotating shaft 42, a second cam 43, a pulse motor 44, and a reduction gear system 45.

The second rotating shaft 42 is transversely stretched between the framed side plates 1*a* and 1*b* and situated in the front of the first rotating shaft 33 for rotating motion. The second cam 43 is fixed to the second rotating shaft 42 so as to face the rear bottom of the first set lever 31. The pulse motor 44 and the gear system 45 both are mounted on the side plate 1*b*. An input gear 45*a* of the gear system 45 is arranged in mesh with a drive gear 44*a* fixed to the output spindle of the motor 44. An output gear 45*b* of the gear system 45 is mounted on that of the second rotating shaft 42 which extending through the side plate 1*b*.

In backward feeding of the paper sheet P, the pulse motor 44 is activated to drive, via the reduction gear system 45, the second rotating shaft 42 and the second cam 43 for rotation in the counter-clockwise direction in FIG. 2. Then, the second cam 43 comes into contact with the bottom of the first set lever 31 and lifts it up. Thus, the first set lever 31 is turned about the stationary shaft 4 in the counter-clockwise direction. Hence, the front end 31*a* of the lever 31 presses the pressure shaft 7 downward against the urging force of the coil springs 8.

Figure 6:
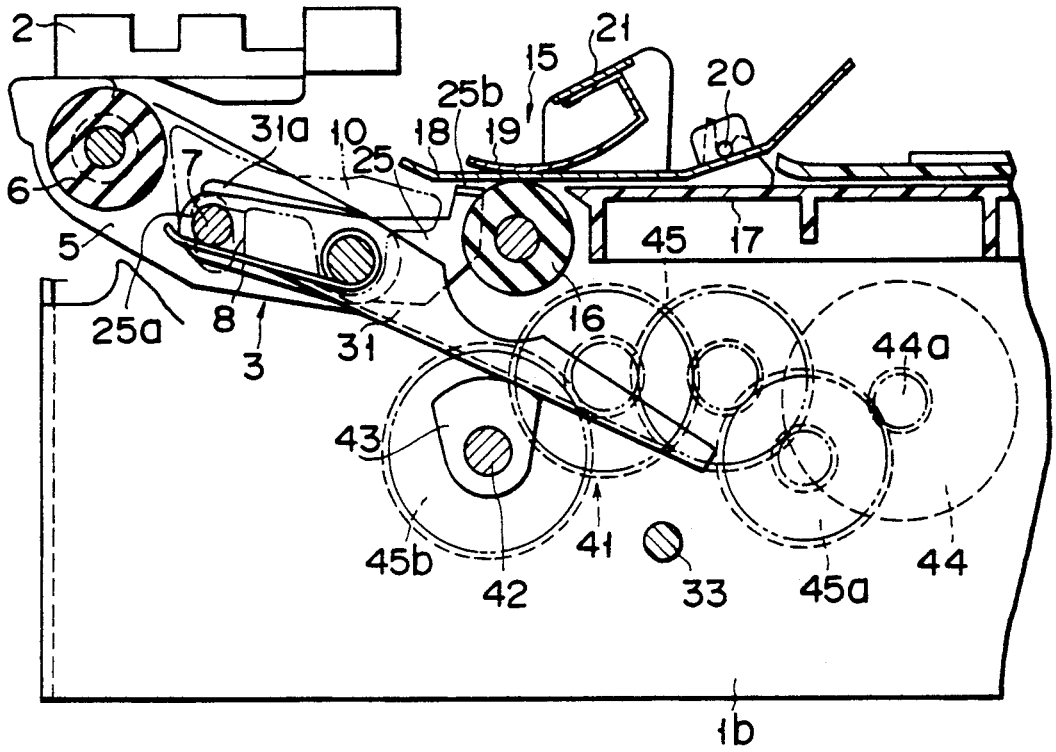
Figure 7:
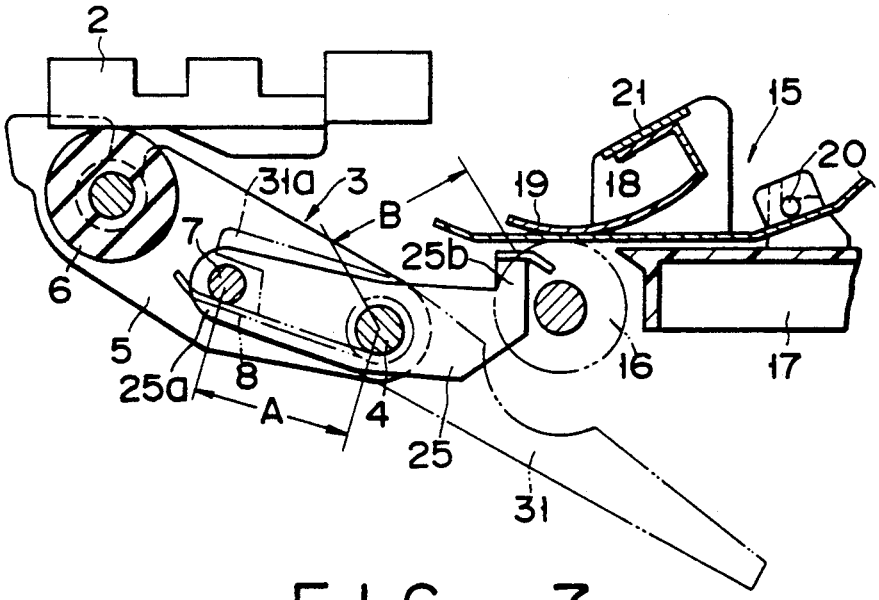

Accordingly, the platen frames 5 are moved downward and the platen roller 6 moves to separate slightly from the print head 2, as illustrated in FIG. 6. It should be noted that the ratio of the distance A between the stationary shaft 4 and the pressure shaft 7 to the distance B between the stationary shaft 4 and the pressing portion 25*b* of the second set lever 25, and the displacement of the first set lever 31 defined by the movement of the second cam 43 are determined so that the platen roller 6 only can be slightly moved downward while the pressing portion 25*b* never lifts up the paper holder.

Accordingly, while the print head 2 is spaced form the platen roller 6 during the backward feeding of the paper sheet P, the holder 18 of the feed mechanism 15 remains in contact with the feed roller 16 at a pressure regardless of the rotation of the second set lever 25. As the result, the paper sheet P extending between the printing head 2 and the platen roller 6 can be fed backward by the reverse rotation of the feed roller 16.

By feeding the paper sheet P backward, labels on the sheet P can be positioned at a specific printing location. Hence, the printing of e.g. bar codes on each level will be conducted from its front end with efficiency.

When the pulse motor 44 is rotated in the reverse direction, the components will be returned by the urging force of the springs 8 to their original positions shown in FIGS. 1 and 4.

Reference numeral 51 in FIG. 1 represents a ribbon supply device which is to be set above the print head 2 when needed. The ribbon supply device 15 supplies with a transfer ribbon which has a width corresponding to the width of the paper sheet P. In action, the ribbon fed from a supply shaft of the device 51 passes between the print head 2 and the platen roller 6 and is taken up onto a take-up shaft. The running of the ribbon is synchronized with the feeding of the paper sheet except during the backward feeding of the sheet. With the ribbon supply device 51, information is printed on each label of the paper sheet in a transfer printing. If no ribbon is in use, a thermal printing paper will be employed. As shown in FIG. 1, the printer further comprises a control lever 57 for varying a contact pressure of the platen roller 6 exerted on the print head 2, and a clamp plate 58 for supporting both the print head 2 and the ribbon supply device 51 at the side of the frame side plate 1*a*. The clamp plate 58 is rockably mounted on the side plate 1*a*.

According to the printer having the foregoing arrangement, a paper sheet is set on the printer in the following manner with the unshown casing being removed. First, the operating lever 34 which stands upright as shown in FIG. 4 is pressed down to rotate the first rotating shaft 33 and the first cam 35. Accordingly, the first set lever 31 rotates about the stationary shaft 4 through a lever movement and its front end 31*a* actuates the pressure shaft 7 to move downward by a considerable distance. As the result, the platen roller 6 is lifted down and becomes spaced from the printing head 2.

Simultaneously, the second set levers 25 are rotated by the pressure shaft 7 about the stationary shaft 4, thereby lifting up their pressing portions 25*b*. Thus, the paper holder 18 is pushed upward by the pressing portions 25*b* and leaves upward from the feed roller 16.

As described above, only by rotating the operating lever 34 downward, the platen roller 6 can be separated from the print head 6 and, simultaneously, the holder 18 can be spaced from the feed roller 16.

Then, a paper sheet P is manually inserted into the printer to be fed between the feed roller 16 and the paper holder 18, and is further transferred to be held between the print head 2 and the platen roller 6. The setting of the paper sheet is completed when the operating lever 34 is turned back to its original position.

With the printer according to the embodiment of the present invention, the departing of the paper holder from the feed roller is performed in interlock with the action of the mechanism for separating the platen roller from the print head. More particularly, the spacing of both the platen roller and the paper holder from the print head and the feed roller respectively can be carried out at a time by the action of the operating lever. Hence, the setting of a paper sheet will be facilitated and the entire arrangement of the printer will be made simple.

The present invention is not limited to the above-mentioned embodiment, and various modifications and changes will be possible without departing from the scope of the present invention.

For example, the platen roller may be replaced with a platen plate. The paper holder may be substituted with a roller. In this case, the first set lever is adapted to engage with and disengage from the roller surface or axis portion of the roller.

Additional advantages and modifications will readily occur to those skilled in the art. Therefore, the invention in its broader aspects is not limited to the specific details, and representative devices, shown and described herein. Accordingly, various modifications may be without departing from the spirit or scope of the general inventive concept as defined by the appended claims and their equivalents.

What is claimed is:

1. A printer comprising:

a support body;

a print head supported by the support body;

a platen unit including a platen facing the print head, a stationary shaft supported by the support body, a support member supporting the platen and rotatably mounted on the stationary shaft so that the platen is movable in directions to contact and leave the print head, and means for urging the platen toward the print head;

feeding means having a feed roller and a holder pressed against the feed roller, for feeding a recording medium supplied between the feed roller and the holder to a position between the print head and the platen by means of rotation of the feed roller;

interlocking means having a pressing portion provided for engagement with the holder and mounted on the platen unit to be movable integrally with the support member, for separating the holder from the feed roller by the pressing portion when the support member is rotated in the direction to leave the platen from the print head; and means for rotating the support member of the platen unit in the direction to leave the platen from the print head.

2. A printer according to claim 1, wherein the rotating means includes a first set lever having an intermediate portion pivotably supported by the stationary shaft, a distal end portion engaged with the support member, and a proximal end portion extending from the intermediate portion in a direction opposite to the distal end portion; and operating means for rotating the first set lever by pressing the proximal end portion of the lever so that the support member is rotated by the distal end of the lever in the direction to leave the platen from the print head.

3. A printer according to claim 2, wherein the operating means includes a rotating shaft rotatably supported by the support body and extending approximately parallel to the stationary shaft, an operating lever fixed to the rotating shaft and capable of being operated from the outside for rotating the rotating shaft, and a cam member mounted on the rotating shaft to face the proximal end portion of the first set lever, for pressing the proximal end portion of the first set lever when the rotating shaft is rotated.

4. A printer according to claim 2, wherein the support member includes a pair of support frames pivotably supported by the stationary shaft and arranged opposite to each other, said platen being supported between the support frames to extend approximately parallel to the stationary shaft, and a pressure shaft transversely stretched between the support frames and located between the stationary shaft and the platen, said distal end portion of the first set lever being engaged the pressure shaft.

5. A printer according to claim 4, wherein the urging means comprises a torsion spring wound on the stationary shaft and having one end fixed to the stationary shaft and the other end engaged with the pressure shaft.

6. A printer according to claim 4, wherein the interlocking means has a second set lever which comprises an intermediate portion rotatably fitted on the stationary shaft, a distal end portion rotatably fitted on the pressure shaft, and a proximal end portion extending from the intermediate portion toward the holder and constituting said pressing portion.

7. A printer according to claim 6, wherein the relation between the distance A from the stationary shaft to the pressure shaft and the distance B from the stationary shaft to the pressing portion of the second set lever is determined so that the pressing portion comes into contact with the holder when the support member has been rotated for spacing the platen from the print head by a given distance.

8. A printer according to claim 7, which further comprises separating means for rotating the support member to a given degree through the first set lever, the separating means having a second rotating shaft rotatably supported by the support body, a second cam member mounted on the second rotating shaft to face the proximal end portion of the first set lever, and driving means supported by the support body, for rotating the second rotating shaft.

9. A printer according to claim 1, wherein the holder includes a guide member detachably mounted on the support body, and an urging member mounted on the support body, for urging the guide member against the feed roller.

10. A printer according to claim 1, wherein said holder is formed in a plate-like shape so as to guide the recording medium.

11. A printer comprising:

a print head;

a platen arranged opposite to the print head;

means for supporting the platen to be movable in directions to touch and leave from the print head;

means for urging the platen toward the print head;

feeding means having a feed roller and a medium guide pressed against the feed roller, for feeding a recording medium supplied between the feed roller and the medium guide to a position between the print head and the platen by means of rotation of the feed roller;

first separating means attached to the support member and having a pressing portion for engagement with the medium guide; and second separating means for rotating the supporting means in the direction to leave the platen from the print head together with the first separating means so as to separate the medium guide from the feed roller by means of the pressing portion.

* * * * *